US011619228B2

(12) United States Patent
Kingseed et al.

(10) Patent No.: US 11,619,228 B2
(45) Date of Patent: Apr. 4, 2023

(54) COMPRESSOR HAVING DIRECTED SUCTION

(71) Applicant: Emerson Climate Technologies, Inc., Sidney, OH (US)

(72) Inventors: Joey L. Kingseed, Sidney, OH (US); Daniel J. Striebich, Troy, OH (US); Joshua S. King, Anna, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 15 days.

(21) Appl. No.: 17/159,692

(22) Filed: Jan. 27, 2021

(65) Prior Publication Data

US 2022/0235762 A1 Jul. 28, 2022

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |
| ***F04C 18/02*** | (2006.01) |
| ***F04C 2/02*** | (2006.01) |
| ***F04C 29/12*** | (2006.01) |
| *F04C 23/00* | (2006.01) |

(52) U.S. Cl.

CPC ..... *F04C 18/0215* (2013.01); *F04C 2/025* (2013.01); *F04C 29/12* (2013.01); *F04C 23/008* (2013.01); *F04C 2230/60* (2013.01); *F04C 2240/805* (2013.01); *F04C 2240/806* (2013.01)

(58) Field of Classification Search

CPC .. F04C 18/0215; F04C 18/0207; F04C 2/025; F04C 15/06; F04C 29/12; F04C 23/008; F04C 2230/60; F04C 2240/805; F04C 2240/806; F04C 2250/10; F04C 2250/101

See application file for complete search history.

(56) References Cited

U.S. PATENT DOCUMENTS

| | | | |
|---|---|---|---|
| 1,365,530 | A | 1/1921 | Moore |
| 2,142,452 | A | 1/1939 | Merrill |

(Continued)

FOREIGN PATENT DOCUMENTS

| | | | |
|---|---|---|---|
| CN | 1208821 | A | 2/1999 |
| CN | 1278892 | A | 1/2001 |

(Continued)

OTHER PUBLICATIONS

International Search Report regarding Application No. PCT/US2022/014027, dated May 4, 2022.

(Continued)

*Primary Examiner* — Theresa Trieu

(74) *Attorney, Agent, or Firm* — Harness, Dickey & Pierce, P.L.C.

(57) ABSTRACT

A compressor includes a shell assembly, a compression mechanism and a conduit. The shell assembly defines a chamber. The compression mechanism is disposed within the chamber of the shell assembly and includes a first scroll member and a second scroll member in meshing engagement with each other. The second scroll member includes a suction inlet. The conduit directs working fluid into the suction inlet and includes a first end defining an inlet opening and a second end defining an outlet opening adjacent to the suction inlet. The second end includes a locating pin that extends outwardly therefrom.

14 Claims, 12 Drawing Sheets

(56) References Cited

U.S. PATENT DOCUMENTS 2,157,918 A 5/1939 Rankin
3,075,686 A 1/1963 Steinhagen
3,817,661 A 6/1974 Ingalls et al.
3,870,440 A 3/1975 Zuercher, Jr.
4,313,715 A 2/1982 Richardson, Jr.
4,343,599 A 8/1982 Kousokabe
4,365,941 A 12/1982 Tojo et al.
4,401,418 A 8/1983 Fritchman
4,412,791 A 11/1983 Lal
4,477,229 A 10/1984 Kropiwnicki et al.
4,496,293 A 1/1985 Nakamura et al.
4,564,339 A 1/1986 Nakamura et al.
4,592,703 A 6/1986 Inaba et al.
4,609,334 A 9/1986 Muir et al.
4,648,811 A 3/1987 Tahata et al.
4,696,629 A 9/1987 Shiibayashi et al.
4,759,696 A 7/1988 Ishiai
4,767,293 A 8/1988 Caillat et al.
4,793,775 A 12/1988 Peruzzi
4,838,769 A 6/1989 Gannaway
4,877,382 A 10/1989 Caillat et al.
4,915,554 A 4/1990 Serizawa et al.
5,007,809 A 4/1991 Kimura et al.
5,030,073 A 7/1991 Serizawa et al.
5,055,010 A 10/1991 Logan
5,064,356 A 11/1991 Horn
5,108,274 A 4/1992 Kakuda et al.
5,114,322 A 5/1992 Caillat et al.
5,197,868 A 3/1993 Caillat et al.
5,219,281 A 6/1993 Caillat et al.
5,240,391 A 8/1993 Ramshankar et al.
5,288,211 A 2/1994 Fry
5,295,813 A 3/1994 Caillat et al.
5,306,126 A 4/1994 Richardson, Jr.
5,344,289 A 9/1994 Fasce
5,366,352 A 11/1994 Deblois et al.
5,427,511 A 6/1995 Caillat et al.
5,435,700 A 7/1995 Park
5,439,361 A 8/1995 Reynolds et al.
5,476,369 A 12/1995 Fowlkes et al.
5,531,078 A 7/1996 Day et al.
5,533,875 A 7/1996 Crum et al.
5,593,294 A 1/1997 Houghtby et al.
5,597,293 A 1/1997 Bushnell et al.
5,645,408 A 7/1997 Fujio et al.
5,707,210 A 1/1998 Ramsey et al.
5,745,992 A 5/1998 Caillat et al.
5,772,411 A 6/1998 Crum et al.
5,772,416 A 6/1998 Caillat et al.
5,931,649 A 8/1999 Caillat et al.
5,992,033 A 11/1999 Scarborough
6,000,917 A 12/1999 Smerud et al.
6,017,205 A 1/2000 Weatherston et al.
6,131,406 A 10/2000 Barowsky et al.
6,139,295 A 10/2000 Utter et al.
6,158,995 A 12/2000 Muramatsu et al.
6,164,934 A 12/2000 Niihara et al.
6,168,404 B1 1/2001 Gatecliff
6,174,150 B1 1/2001 Tsubono et al.
6,186,753 B1 2/2001 Hugenroth et al.
6,244,834 B1 6/2001 Matsuda et al.
6,261,071 B1 7/2001 Williams et al.
6,293,776 B1 9/2001 Hahn et al.
6,352,418 B1 3/2002 Kohsokabe et al.
6,364,643 B1 4/2002 Milliff
6,402,485 B2 6/2002 Hong et al.
6,454,538 B1 9/2002 Witham et al.
6,474,964 B2 11/2002 De Bernardi et al.
6,537,019 B1 3/2003 Dent
6,685,441 B2 2/2004 Nam
6,709,244 B2 3/2004 Pham
6,736,607 B2 5/2004 Ginies et al.
6,814,546 B2 11/2004 Sekiguchi
6,857,808 B1 2/2005 Sugimoto et al.
6,887,050 B2 5/2005 Haller
6,896,496 B2 5/2005 Haller et al.
7,018,183 B2 3/2006 Haller et al.
7,018,184 B2 3/2006 Skinner et al.
7,063,523 B2 6/2006 Skinner
7,094,043 B2 8/2006 Skinner
7,108,494 B2 9/2006 Nam
7,137,775 B2 11/2006 Hopkins
7,147,443 B2 12/2006 Ogawa et al.
7,207,787 B2 4/2007 Liang et al.
7,311,501 B2 12/2007 Wehrenberg et al.
7,318,710 B2 1/2008 Lee et al.
7,416,395 B2 8/2008 Sato
7,503,755 B2 3/2009 Lai et al.
RE40,830 E 7/2009 Caillat
7,686,592 B2 3/2010 Inoue et al.
7,699,589 B2 4/2010 Terauchi et al.
7,708,536 B2 5/2010 Ginies et al.
7,771,180 B2 8/2010 Cho et al.
7,862,312 B2 1/2011 Gopinathan
7,905,715 B2 3/2011 Hiwata et al.
8,133,043 B2 3/2012 Duppert
8,152,503 B2 4/2012 Haller
8,348,647 B2 1/2013 Kiyokawa et al.
8,814,537 B2 8/2014 Ignatiev et al.
8,974,198 B2 3/2015 Schaefer et al.
8,992,186 B2 3/2015 Silveira et al.
9,051,934 B2 6/2015 Fraser
9,057,270 B2 6/2015 Strawn et al.
9,366,462 B2 6/2016 Perevozchikov et al.
10,094,600 B2 10/2018 Doepker et al.
2001/0006603 A1 7/2001 Hong et al.
2001/0055536 A1 12/2001 Bernardi et al.
2002/0090305 A1 7/2002 Myung et al.
2003/0072662 A1 4/2003 Reinhart
2004/0057843 A1 3/2004 Haller et al.
2004/0057849 A1 3/2004 Skinner et al.
2004/0057857 A1 3/2004 Skinner
2004/0126258 A1 7/2004 Lai et al.
2004/0166008 A1 8/2004 Lai et al.
2004/0170509 A1 9/2004 Wehrenberg et al.
2004/0228751 A1 11/2004 Shin
2005/0129534 A1 6/2005 Lee
2006/0073061 A1 4/2006 Sato
2006/0078452 A1 4/2006 Park et al.
2006/0127262 A1 6/2006 Shin et al.
2006/0177335 A1 8/2006 Hwang et al.
2006/0222545 A1 10/2006 Nam et al.
2006/0222546 A1 10/2006 Lee et al.
2006/0245967 A1 11/2006 Gopinathan
2006/0275150 A1 12/2006 Barth
2007/0178002 A1 8/2007 Hiwata et al.
2007/0183914 A1 8/2007 Gopinathan
2007/0237664 A1 10/2007 Joo et al.
2009/0110586 A1 4/2009 Brabek et al.
2009/0136344 A1 5/2009 Chen et al.
2009/0229303 A1 9/2009 Iversen et al.
2010/0021330 A1 1/2010 Haller
2012/0134859 A1 5/2012 Duppert
2012/0148433 A1 6/2012 Liang et al.
2013/0026749 A1 1/2013 O'Brien et al.
2013/0039792 A1 2/2013 Hiratsuka et al.
2013/0081710 A1 4/2013 Ignatiev et al.
2013/0089451 A1 4/2013 Ahn et al.
2013/0108496 A1 5/2013 Nakai et al.
2013/0129549 A1 5/2013 Sakuda et al.
2014/0017106 A1 1/2014 Strawn et al.
2014/0069139 A1* 3/2014 Perevozchikov ... F04C 18/0292 62/505
2016/0348675 A1 12/2016 Ishii et al.
2017/0002812 A1 1/2017 Duppert
2018/0320689 A1* 11/2018 Kono ..... F04C 18/0215
2019/0041106 A1 2/2019 Piscopo
2019/0041107 A1 2/2019 Piscopo et al.

(56) References Cited

U.S. PATENT DOCUMENTS

| | | | |
|---|---|---|---|
| 2020/0309124 | A1 | 10/2020 | King |
| 2020/0392953 | A1 | 12/2020 | Stover et al. |

FOREIGN PATENT DOCUMENTS

| | | | | |
|---|---|---|---|---|
| CN | 1354326 | A | 6/2002 | |
| CN | 1371444 | A | 9/2002 | |
| CN | 1482365 | A | 3/2004 | |
| CN | 1629476 | A | 6/2005 | |
| CN | 1779244 | A | 5/2006 | |
| CN | 1869443 | A | 11/2006 | |
| CN | 101235932 | A | 8/2008 | |
| CN | 101415947 | A | 4/2009 | |
| CN | 102216617 | A | 10/2011 | |
| CN | 202926625 | U | 5/2013 | |
| CN | 203453064 | U | 2/2014 | |
| CN | 104350279 | A | 2/2015 | |
| CN | 104976448 | A | 10/2015 | |
| CN | 104999172 | A | 10/2015 | |
| CN | 204934897 | U | 1/2016 | |
| CN | 205064214 | U | 3/2016 | |
| CN | 107246393 | A | 10/2017 | |
| EP | 0438243 | A1 | 7/1991 | |
| EP | 475545 | A1 * | 3/1992 | ..... F01C 1/0215 |
| EP | 0529660 | A1 | 3/1993 | |
| EP | 1338795 | A1 | 8/2003 | |
| EP | 1541868 | A1 | 6/2005 | |
| JP | S62182486 | A | 8/1987 | |
| JP | S63183773 | A | 7/1988 | |
| JP | H04347387 | A | 12/1992 | |
| JP | H05157064 | A | 6/1993 | |
| JP | H05302581 | A | 11/1993 | |
| JP | H07197893 | A | 8/1995 | |
| JP | H08319965 | A | 12/1996 | |
| JP | H11141470 | A | 5/1999 | |
| JP | 2001165065 | A | 6/2001 | |
| JP | 2002155875 | A | 5/2002 | |
| JP | 2002155877 | A | 5/2002 | |
| JP | 2002235524 | A | 8/2002 | |
| JP | 2003120539 | A | 4/2003 | |
| JP | 2004150370 | A | 5/2004 | |
| JP | 2005188353 | A | 7/2005 | |
| JP | 2006144729 | A | 6/2006 | |
| JP | 2008223605 | A | 9/2008 | |
| JP | 2009019570 | A | 1/2009 | |
| JP | 2010043627 | A | 2/2010 | |
| JP | 2011236861 | A | 11/2011 | |
| KR | 20010064538 | A | 7/2001 | |
| KR | 20010068323 | A | 7/2001 | |
| KR | 20020024708 | A | 4/2002 | |
| KR | 20080019509 | A | 3/2008 | |
| KR | 20090045352 | A | 5/2009 | |
| KR | 20140034345 | A | 3/2014 | |
| KR | 20180107482 | A | 10/2018 | |
| KR | 20190025250 | A | 3/2019 | |
| WO | WO-2006109475 | A1 | 10/2006 | |
| WO | WO-2007025883 | A1 | 3/2007 | |
| WO | WO-2007114582 | A1 | 10/2007 | |
| WO | WO-2008102940 | A1 | 8/2008 | |
| WO | WO-2009090856 | A2 | 7/2009 | |
| WO | WO-2011147005 | A1 | 12/2011 | |
| WO | WO-2014043444 | A1 | 3/2014 | |

OTHER PUBLICATIONS

Written Opinion of ISA regarding Application No. PCT/US2022/014027, dated May 4, 2022.
Non-Final Office Action regarding U.S. Appl. No. 16/941,060 dated Aug. 2, 2021.
Notice of Allowance regarding U.S. Appl. No. 16/941,060 dated Oct. 6, 2021.
Notice of Allowance regarding U.S. Appl. No. 16/803,576 dated Sep. 16, 2021.
Non-Final Office Action regarding U.S. Appl. No. 15/930,785 dated May 6, 2022.
International Search Report regarding International Application No. PCT/BR2010/000179, dated Sep. 1, 2010.
Written Opinion of the International Searching Authority regarding International Application No. PCT/BR2010/000179, dated Sep. 1, 2010.
International Search Report regarding International Application No. PCT/US2012/056067, dated Feb. 19, 2013.
Written Opinion of the International Searching Authority regarding International Application No. PCT/US2012/056067, dated Feb. 19, 2013.
Restriction Requirement regarding U.S. Appl. No. 13/610,274, dated Aug. 16, 2013.
Search Report regarding European Patent Application No. 10851912.5, dated Nov. 15, 2013.
Office Action regarding Japanese Patent Application No. 2013-511484, dated Nov. 19, 2013.
Office Action regarding U.S. Appl. No. 13/610,274, dated Nov. 27, 2013.
International Search Report regarding International Application No. PCT/US2013/059612, dated Dec. 9, 2013.
Written Opinion of the International Searching Authority regarding International Application No. PCT/US2013/059612, dated Dec. 9, 2013.
Office Action regarding U.S. Appl. No. 13/699,207, dated Dec. 18, 2013.
Notice of Allowance regarding U.S. Appl. No. 13/610,274, dated Mar. 24, 2014.
Notice of Allowance regarding U.S. Appl. No. 13/610,274, dated Jul. 18, 2014.
Office Action regarding European Patent Application No. 10851912.5, dated Jul. 18, 2014.
Office Action regarding U.S. Appl. No. 13/699,207, dated Jul. 24, 2014.
Office Action regarding Chinese Patent Application No. 201080066999.X, dated Sep. 17, 2014.
Notice of Allowance regarding U.S. Appl. No. 13/699,207, dated Nov. 24, 2014.
Office Action regarding Chinese Patent Application No. 201210376153.7, dated Dec. 3, 2014. Translation provided by Unitalen Attorneys At Law.
Restriction Requirement regarding U.S. Appl. No. 14/025,887, dated Jan. 5, 2015.
Restriction Requirement regarding U.S. Appl. No. 13/930,834, dated Jan. 29, 2015.
Office Action regarding U.S. Appl. No. 14/025,887, dated Mar. 26, 2015.
Notice of Allowance regarding U.S. Appl. No. 13/930,834, dated Apr. 24, 2015.
Office Action regarding Chinese Patent Application No. 201210376153.7, dated Jul. 3, 2015. Translation provided by Unitalen Attorneys at Law.
Office Action regarding U.S. Appl. No. 14/025,887, dated Jul. 23, 2015.
Office Action regarding Chinese Patent Application No. 201310286638.1, dated Jul. 27, 2015. Translation provided by Unitalen Attorneys at Law.
Office Action regarding U.S. Appl. No. 14/025,887, dated Dec. 3, 2015.
Office Action regarding Chinese Patent Application No. 201210376153.7, dated Dec. 28, 2015. Translation provided by Unitalen Attorneys at Law.
Office Action regarding Chinese Patent Application No. 201310286638.1, dated Jan. 21, 2016. Translation provided by Unitalen Attorneys at Law.
Office Action regarding Chinese Patent Application No. 201380047907.7, dated Mar. 8, 2016. Translation provided by Unitalen Attorneys at Law.
Notice of Allowance regarding U.S. Appl. No. 14/025,887, dated Apr. 12, 2016.
Search Report regarding European Patent Application No. 13836817.0, dated Jun. 1, 2016.

(56) References Cited

OTHER PUBLICATIONS

Office Action regarding Korean Patent Application No. 10-2012-7033723, dated Aug. 22, 2016.
Office Action regarding Chinese Patent Application No. 201380047907.7, dated Nov. 8, 2016. Translation provided by Unitalen Attorneys at Law.
Office Action regarding Chinese Patent Application No. 201380047907.7, dated Apr. 12, 2017. Translation provided by Unitalen Attorneys at Law.
Office Action regarding U.S. Appl. No. 15/180,570, dated Oct. 5, 2017.
Office Action regarding U.S. Appl. No. 15/180,570, dated Mar. 22, 2018.
Notice of Allowance regarding U.S. Appl. No. 15/180,570, dated May 31, 2018.
Notice of Allowance regarding U.S. Appl. No. 15/180,570, dated Jul. 19, 2018.
Office Action regarding Indian Patent Application No. 476/MUMNP/2015, dated Sep. 7, 2018.
Office Action regarding Indian Patent Application No. 10655/DELNP/2012, dated Sep. 28, 2018.
Office Action regarding European Patent Application No. 13836817.0, dated Sep. 10, 2019.
Office Action regarding U.S. Appl. No. 16/154,097, dated Jun. 23, 2020.
Office Action regarding U.S. Appl. No. 16/154,364, dated Aug. 17, 2020.
International Search Report regarding International Application No. PCT/US2020/025564, dated Jul. 8, 2020.
Written Opinion of the International Searching Authority regarding International Application No. PCT/US2020/025564, dated Jul. 8, 2020.
International Search Report regarding International Application No. PCT/US2020/037004, dated Sep. 21, 2020.
Written Opinion of the International Searching Authority regarding International Application No. PCT/US2020/037004, dated Sep. 21, 2020.
Notice of Allowance regarding U.S. Appl. No. 16/154,097, dated Oct. 27, 2020.
Notice of Allowance regarding U.S. Appl. No. 16/154,364, dated Jan. 6, 2021.
Non-Final Office Action regarding U.S. Appl. No. 16/803,576 dated Jun. 1, 2021.

* cited by examiner

COMPRESSOR HAVING DIRECTED SUCTION

FIELD

The present disclosure relates to a compressor having directed suction.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, a compressor includes a shell assembly, a compression mechanism and a conduit. The shell assembly defines a chamber. The compression mechanism is disposed within the chamber of the shell assembly and includes a first scroll member and a second scroll member in meshing engagement with each other. The second scroll member includes a suction inlet. The conduit directs working fluid into the suction inlet and includes a first end defining an inlet opening and a second end defining an outlet opening adjacent to the suction inlet. The second end includes an attachment pin that extends outwardly therefrom.

In some configurations of the compressor of the above paragraph, an end of the pin is chamfered.

In some configurations of the compressor of any one or more of the above paragraphs, the second end includes an arcuate connecting arm. The pin extends from the connecting arm.

In some configurations of the compressor of any one or more of the above paragraphs, the connecting arm is configured to snap into engagement with the second scroll member. The connecting arm includes a first boss extending therefrom and received within an externally located slot of the second scroll member when the connecting arm snaps into engagement with the second scroll member.

In some configurations of the compressor of any one or more of the above paragraphs, the connecting arm is configured to snap into engagement with the second scroll member. The second scroll member includes externally located grooves formed therein and the connecting arm includes resiliently flexible tabs extending therefrom. The resiliently flexible tabs are received within respective grooves to prevent axial movement of the conduit relative to the second scroll member when the connecting arm snaps into engagement with the scroll member.

In some configurations of the compressor of any one or more of the above paragraphs, a plurality of attachment pins extend from the second end of the conduit.

In another form, a compressor includes a shell assembly, a compression mechanism, and a conduit. The shell assembly defines a chamber. The compression mechanism is disposed within the chamber of the shell assembly and includes a first scroll member and a second scroll member in meshing engagement with each other. The second scroll member includes a suction inlet. The conduit directs working fluid into the suction inlet and includes a body and an arcuate connecting arm. The body has a first end defining an inlet opening and a second end defining an outlet opening. The arcuate connecting arm is configured to snap into engagement with the second scroll member and has attachment pins extending outwardly therefrom.

In some configurations of the compressor of the above paragraph, the arcuate connecting arm includes end portions and a middle portion disposed between the end portions. The attachment pins extend from a wall of the middle portion.

In some configurations of the compressor of any one or more of the above paragraphs, at least one reinforcement rib extends from the middle portion and the body. The at least one reinforcement rib is positioned between two of the attachment pins.

In some configurations of the compressor of any one or more of the above paragraphs, the arcuate connecting arm includes end portions and a middle portion disposed between the end portions. Reinforcement ribs extend from the middle portion and the body. The attachment pins are integral with at least two of the reinforcement ribs.

In some configurations of the compressor of any one or more of the above paragraphs, the attachment pins extend in one of a radial direction and an axial direction.

In yet another form, the present disclosure provides a method for coupling a conduit to a compression mechanism. The method includes coupling an attachment tool to the conduit; coupling the conduit to a scroll member of the compression mechanism via the attachment tool; and removing the attachment tool from the conduit after the conduit is coupled to the scroll member. The conduit includes an end having at least one attachment pin that is securely received in a respective aperture in the attachment tool when the attachment tool is coupled to the conduit.

In some configurations of the method of the above paragraph, an end of the attachment pin is chamfered to facilitate coupling of the attachment tool to the conduit.

In some configurations of the method of any one or more of the above paragraphs, an end surface of the attachment tool abuts against a wall of the conduit when the attachment tool is coupled to the conduit.

In some configurations of the method of any one or more of the above paragraphs, the conduit includes a reinforcement rib. The attachment tool has a recess that receives the reinforcement rib when the attachment tool is coupled to the conduit.

In some configurations of the method of any one or more of the above paragraphs, when the attachment tool is coupled to the conduit, a first end surface of the attachment tool abuts against a first wall of the conduit and a second end surface of the attachment tool abuts against a second wall of the conduit that is offset from the first wall of the conduit.

In some configurations of the method of any one or more of the above paragraphs, the second end of the conduit includes a boss and a resiliently flexible tab and the scroll member includes an externally located slot and an externally located groove. When the conduit is coupled to the scroll member, the boss is received in the slot and the resiliently flexible tab is received in the groove.

In some configurations of the method of any one or more of the above paragraphs, a reinforcement rib extends from the conduit. The attachment pin is integral with the reinforcement rib.

In some configurations of the method of any one or more of the above paragraphs, the attachment pin extends in one of a radial direction and an axial direction.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
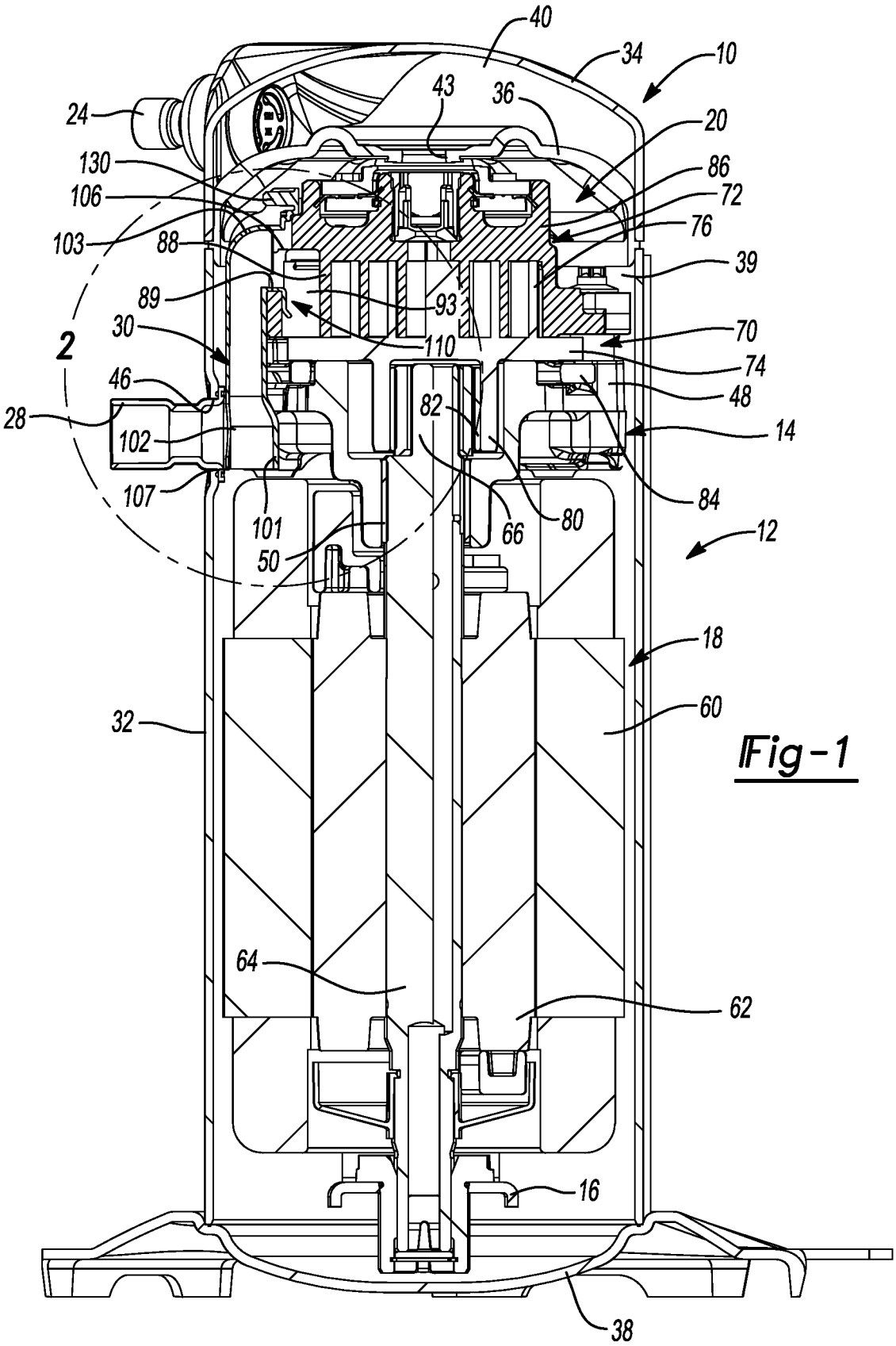
FIG. 1 is a cross-sectional view of a compressor having a suction conduit according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided and may include a hermetic shell assembly 12, first and second bearing housing assemblies 14, 16, a motor assembly 18, a compression mechanism 20, a discharge port or fitting 24, a suction port or fitting 28, and a suction conduit 30.

As shown in FIG. 1, the shell assembly 12 may form a compressor housing and may include a cylindrical shell 32, an end cap 34 at an upper end thereof, a transversely extending partition 36, and a base 38 at a lower end thereof. The shell 32, the base 38 and the partition 36 may cooperate to define a suction-pressure chamber 39. The end cap 34 and the partition 36 may define a discharge-pressure chamber 40. The partition 36 may separate the discharge-pressure chamber 40 from the suction-pressure chamber 39. A discharge-pressure passage 43 may extend through the partition 36 to provide communication between the compression mechanism 20 and the discharge-pressure chamber 40. The suction fitting 28 may be attached to the shell assembly 12 at an opening 46.

As shown in FIG. 1, the first bearing housing assembly 14 may be disposed within the suction-pressure chamber and may be fixed relative to the shell 32. The first bearing housing assembly 14 may include a first main bearing housing 48 and a first bearing 50. The first main bearing housing 48 may house the first bearing 50 therein. The first main bearing housing 48 may fixedly engage the shell 32 and may axially support the compression mechanism 20.

As shown in FIG. 1, the motor assembly 18 may be disposed within the suction-pressure chamber 39 and may include a stator 60 and a rotor 62. The stator 60 may be press fit into the shell 32. The rotor 62 may be press fit on a drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat.

As shown in FIG. 1, the compression mechanism 20 may be disposed within the suction-pressure chamber 39 and may include an orbiting scroll 70 and a non-orbiting scroll 72. The first scroll member or orbiting scroll 70 may include an end plate 74 and a spiral wrap 76 extending therefrom. A cylindrical hub 80 may project downwardly from the end plate 74 and may include a drive bushing 82 disposed therein. The drive bushing 82 may include an inner bore (not numbered) in which the crank pin 66 is drivingly disposed. The crank pin flat may drivingly engage a flat surface in a portion of the inner bore to provide a radially compliant driving arrangement. An Oldham coupling 84 may be engaged with the orbiting and non-orbiting scrolls 70, 72 to prevent relative rotation therebetween.

Figure 2:
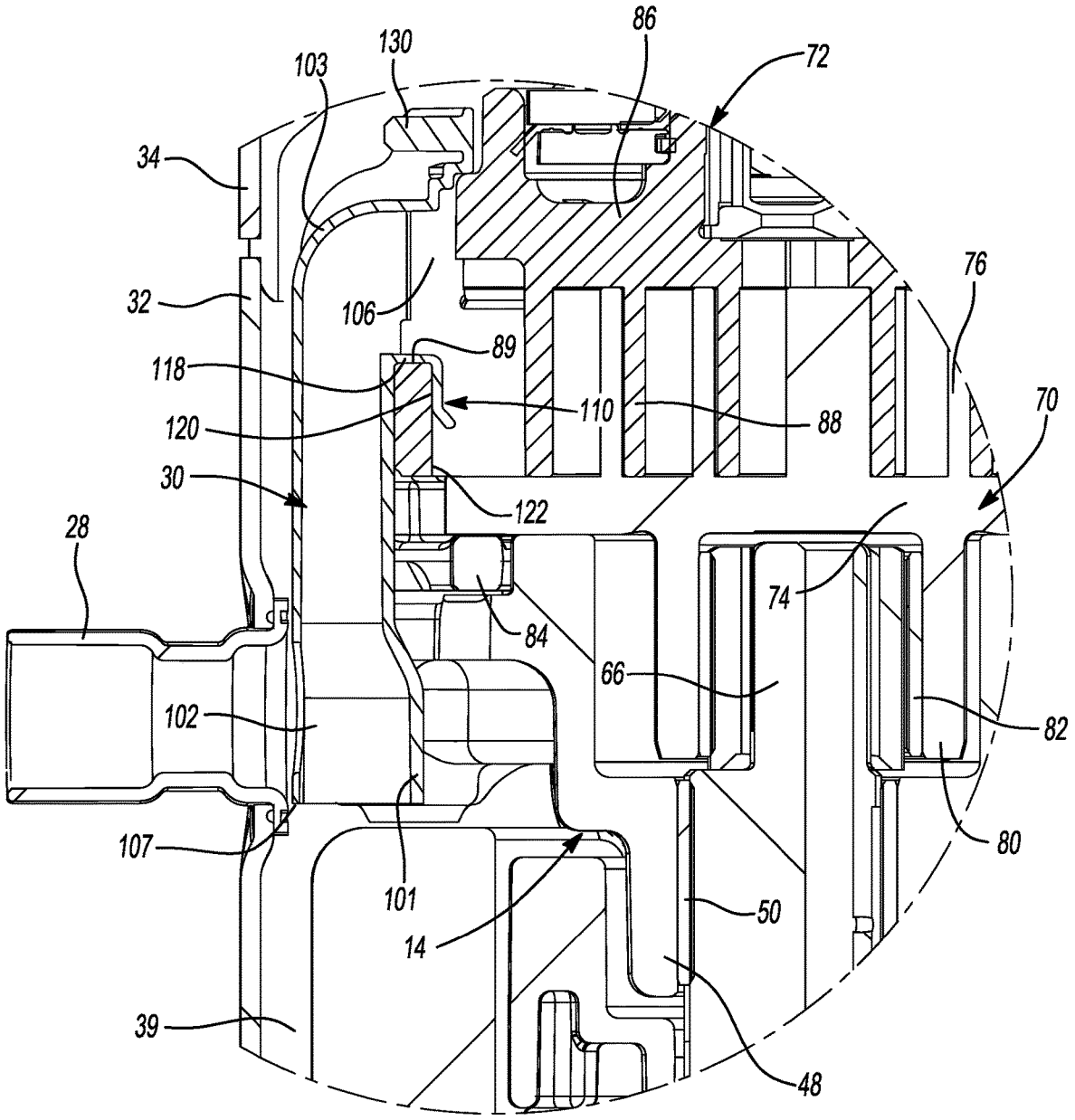
FIG. 2 is a close-up view of a portion of the compressor indicated as area 2 in FIG. 1.
Figure 3:
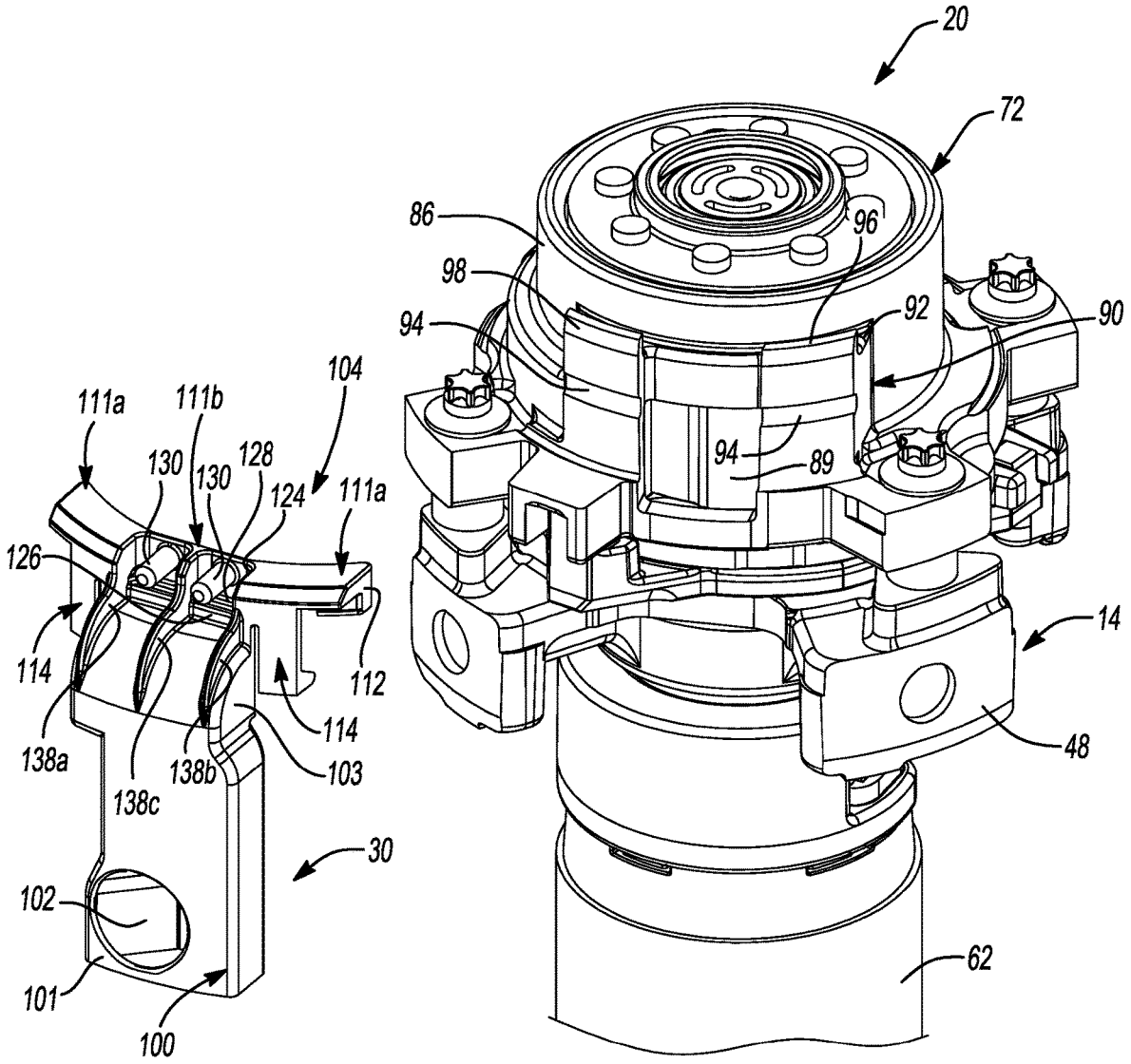
FIG. 3 is a perspective view of a suction conduit and a non-orbiting scroll of a compression mechanism shown disconnected from each other.

As shown in FIG. 1, the second scroll member or non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20. As shown in FIGS. 1-3, a suction inlet 89 may be formed in the non-orbiting scroll 72 and may provide fluid communication between the suction conduit 30 and a radially outermost fluid pocket 93 formed by the spiral wraps 76, 88.

Figure 4:
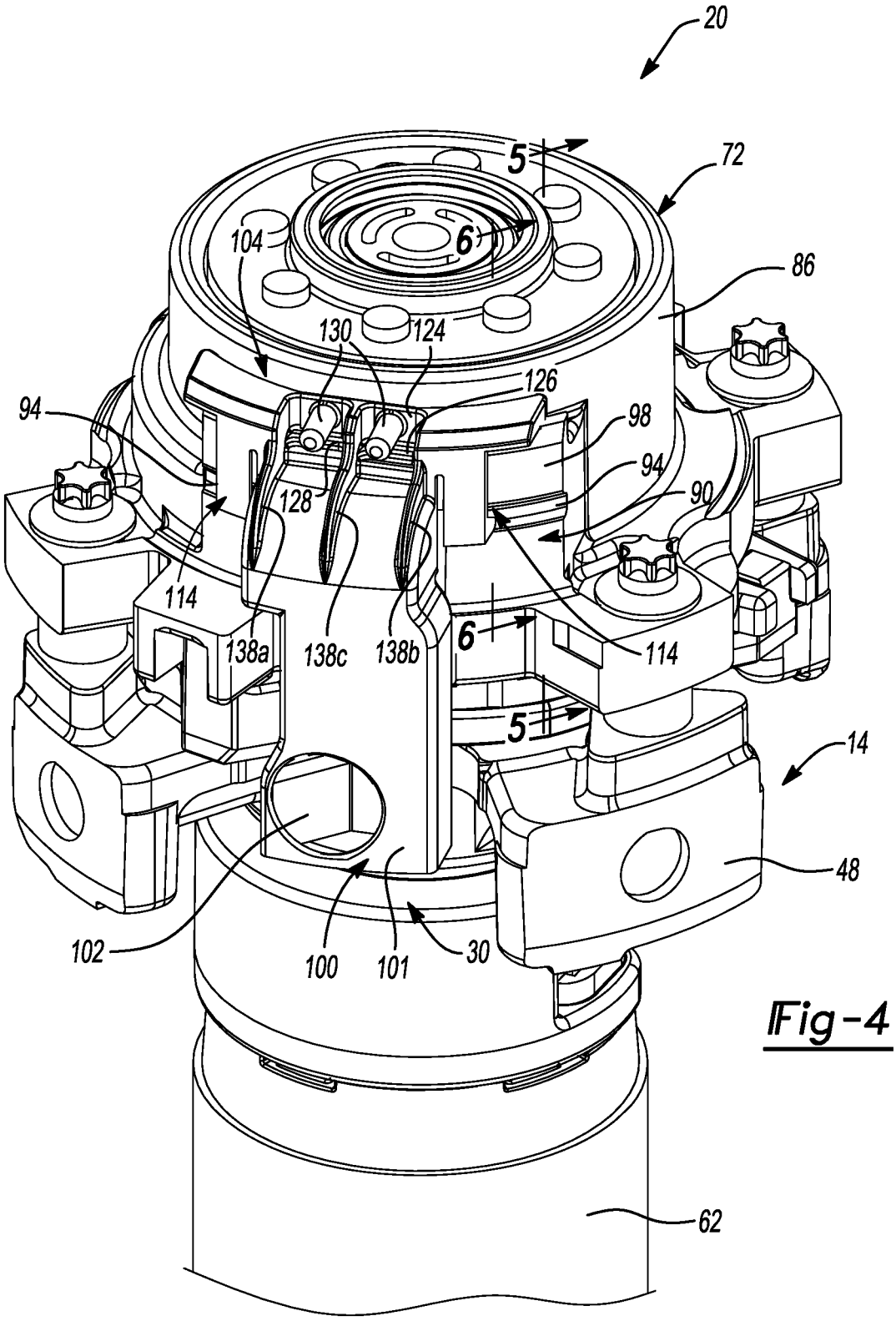
FIG. 4 is a perspective view of the suction conduit and the non-orbiting scroll of the compression mechanism shown connected to each other.
Figure 5:
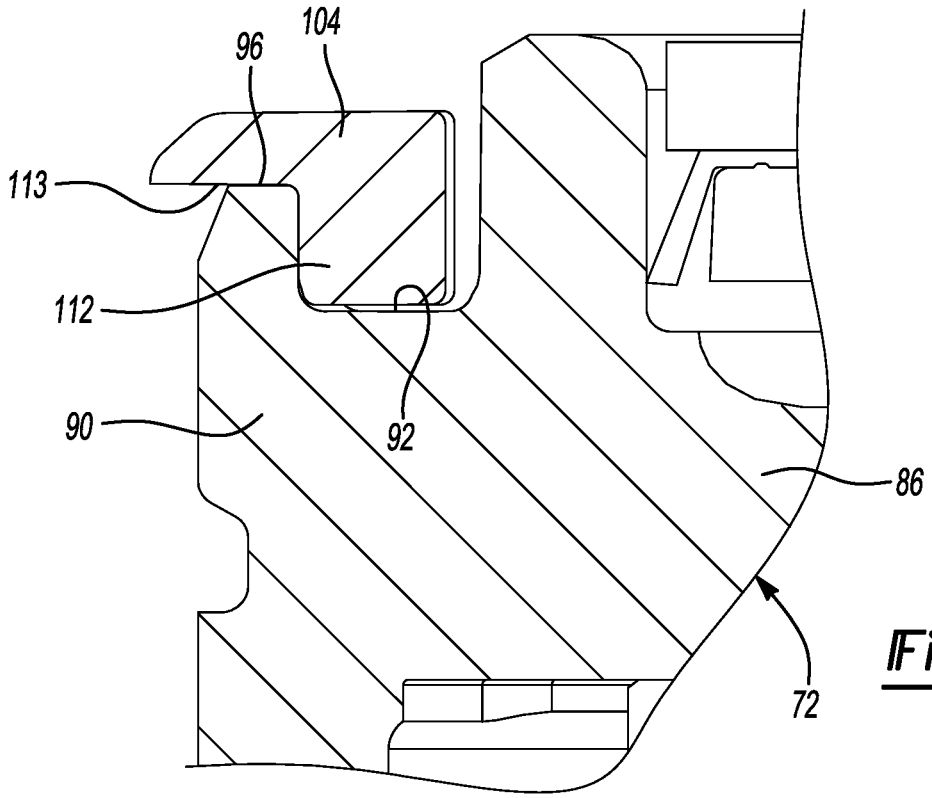
FIG. 5 is a partial cross-sectional view of the suction conduit and the non-orbiting scroll connected to each other taken along line 5-5 of FIG. 4.
Figure 6:
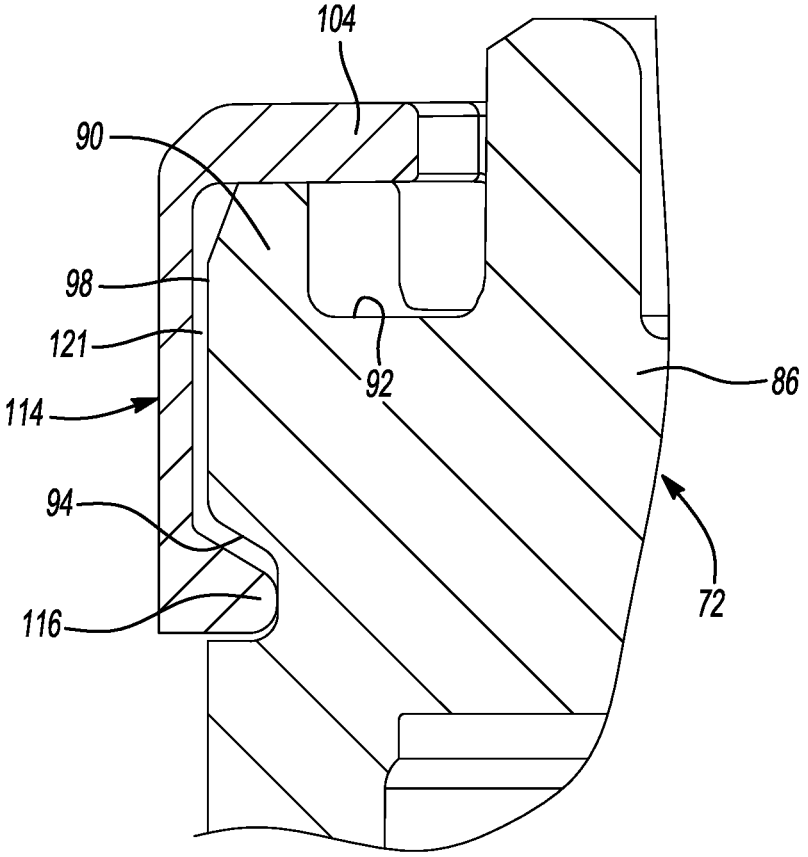
FIG. 6 is another partial cross-sectional view of the suction conduit and the non-orbiting scroll connected to each other taken along line 6-6 of FIG. 4.

With reference to FIGS. 3-6, the non-orbiting scroll 72 also has a wall 90 that is integral with the end plate 86 and may include an externally located first slot or groove 92 (FIGS. 3 and 5; the first slot 92 is located outside of the suction inlet 89) and a plurality of externally located second slots or grooves 94 (FIGS. 3, 4 and 6; the second slots 94 are located outside of the suction inlet 89). The first slot 92 may be machined, for example, in a top surface 96 of the wall 90. The plurality of second slots 94 may be machined, for example, in a lateral surface 98 of the wall 90 (i.e., the lateral surface 98 of the wall 90 is approximately perpendicular to the top surface 96 of the wall 90). In some configurations, the slots 94 may be square cut. The wall 90 may also define the suction inlet 89, which may be spaced apart from the first slot 92. The suction inlet 89 may also be positioned between two of the second grooves 94.

The suction conduit 30 may direct working fluid at a suction-pressure from the suction fitting 28 to the suction inlet 89 of the non-orbiting scroll 72 so that working fluid can be directed into the radially outermost fluid pocket 93 and subsequently compressed by the compression mechanism 20. As shown in FIGS. 1, 2 and 4, the suction conduit 30 may snap into engagement with the wall 90 of the non-orbiting scroll 72. The suction conduit 30 may be injection molded or otherwise formed from a polymeric or metallic material, for example. The suction conduit 30 may include a body 100 and a connecting arm 104. The body 100 may include a first end 101 and a second end 103. A circular-shaped inlet opening 102 (FIGS. 1-4, 7 and 8) may be formed at or near the first end 101 of the body 100 and an outlet opening 106 (FIGS. 1, 2 and 8) may be formed at or near the second end 103 of the body 100. The first end 101 may be adjacent to the suction fitting 28 (i.e., the first end 101 may contact the suction fitting 28 or may be spaced apart from the suction fitting 28). In some configurations, the inlet opening 102 may be concentric with and/or generally aligned with the suction fitting 28.

The outlet opening 106 may provide fluid communication between the suction conduit 30 and the compression mechanism 20. That is, working fluid that flows into the suction conduit 30 through the inlet opening 102 may exit the suction conduit 30 through the outlet opening 106. From the outlet opening 106, the working fluid may be directed into the radially outermost fluid pocket 93 and subsequently compressed by the compression mechanism 20.

A bridge or clip 110 (FIGS. 1, 2 and 8) may extend from the body 100 and may be disposed at or near a bottom of the outlet opening 106. The bridge 110 may include a first member 118 and a second member 120 extending perpendicularly to the first member 118. When the suction conduit 30 snaps into engagement with the non-orbiting scroll 72, the bridge 110 may extend at least partially into the suction inlet 89 and the first member 118 may abut an upper surface of the wall 90.

The connecting arm 104 may extend from the second end 103 of the body 100 and may be disposed at or near a top of the outlet opening 106. The connecting arm 104 may be arcuate and may snap into engagement with the wall 90 of the non-orbiting scroll 72. The connecting arm 104 may include end portions 111*a* and a middle portion 111*b*. The end portions 111*a* may include bosses 112 and a plurality of resiliently flexible tabs 114. Each boss 112 may extend in an axial direction from a respective end portion 111*a* (i.e., the bosses 112 extend in a direction parallel to a longitudinal axis of the shaft 64 when the conduit 30 is assembled to the non-orbiting scroll 72). As shown in FIG. 5, each boss 112 may be received in the first slot 92 of the non-orbiting scroll 72 when the connecting arm 104 snaps into engagement with the wall 90 of the non-orbiting scroll 72. In this way, the suction conduit 30 is prevented from moving in a radial direction relative to the non-orbiting scroll 72 (i.e., the suction conduit 30 is prevented from moving in a direction perpendicular to the longitudinal axis of the shaft 64). As shown in FIG. 5, a bottom surface 113 of the connecting arm 104 may abut against the top surface 96 of the wall 90 when the connecting arm 104 snaps into engagement with the wall 90 of the non-orbiting scroll 72.

Figure 8:
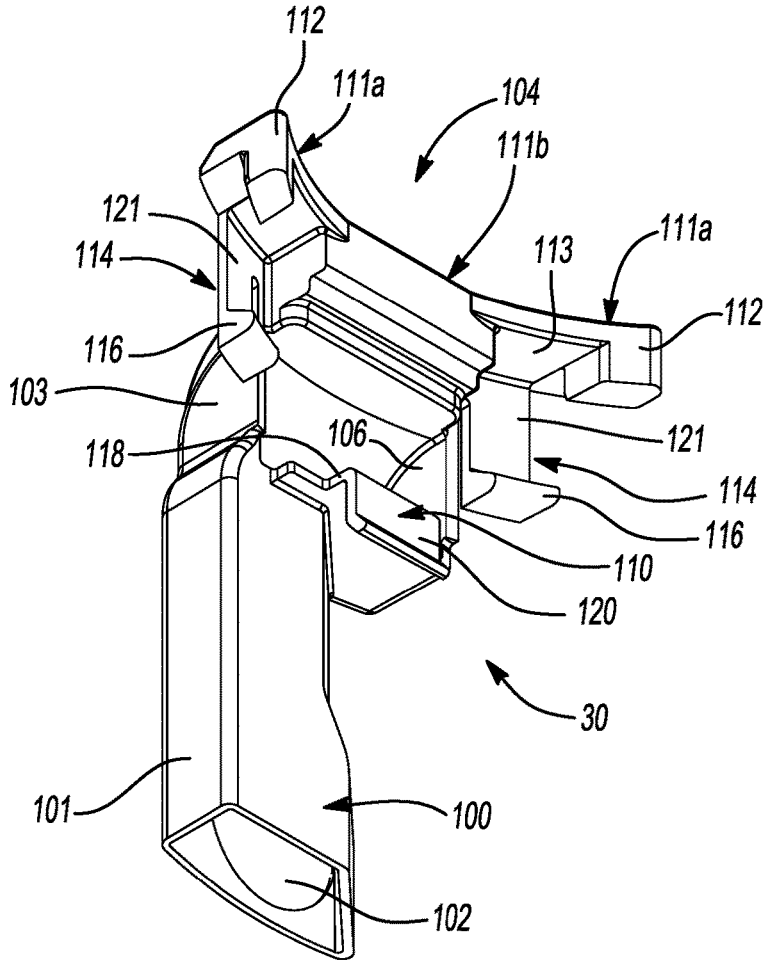
FIG. 8 is another perspective view of the suction conduit.
Figure 9:
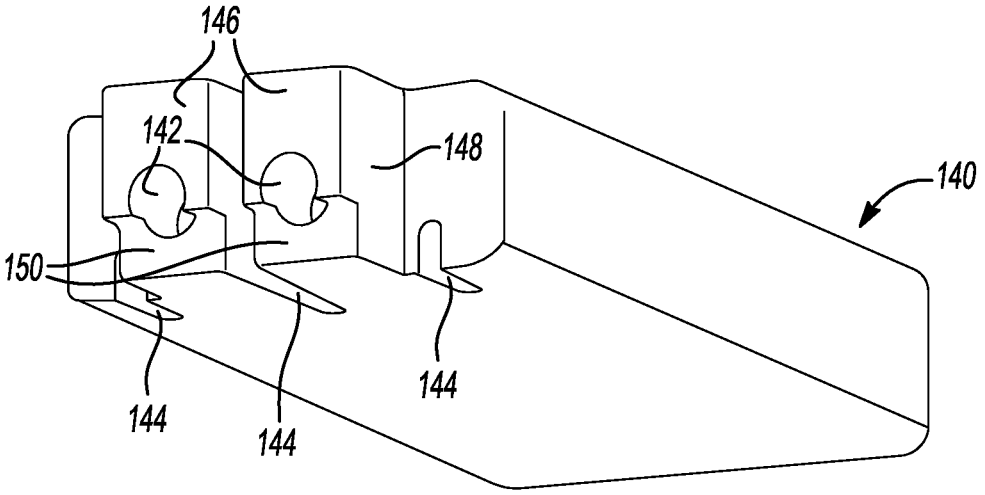
FIG. 9 is a perspective view of an assembly tool.

The plurality of resiliently flexible tabs 114 may have barbed tips 116. The plurality of resiliently flexible tabs 114 may extend from the connecting arm 104 in an axial direction (i.e., the plurality of resiliently flexible tabs 114 extend in a direction parallel to the longitudinal axis of the shaft 64 when the conduit 30 is assembled to the non-orbiting scroll 72). As shown in FIG. 8, the plurality of resiliently flexible tabs 114 are positioned between the bosses 112. In some configurations, the plurality of resiliently flexible tabs 114 may be positioned outside of the bosses 112 (i.e., the bosses 112 are disposed between the flexible tabs 114). The flexible tabs 114 may snap into engagement with the wall 90 of the non-orbiting scroll 72 (i.e., the barbed tips 116 of the flexible tabs 114 may snap into engagement with corresponding second grooves 94 and a surface 121 of the flexible tabs 114 may abut against the lateral surface 98 of the wall 90) such that the suction conduit 30 is prevented from moving in the axial direction relative to the non-orbiting scroll 72.

Figure 7:
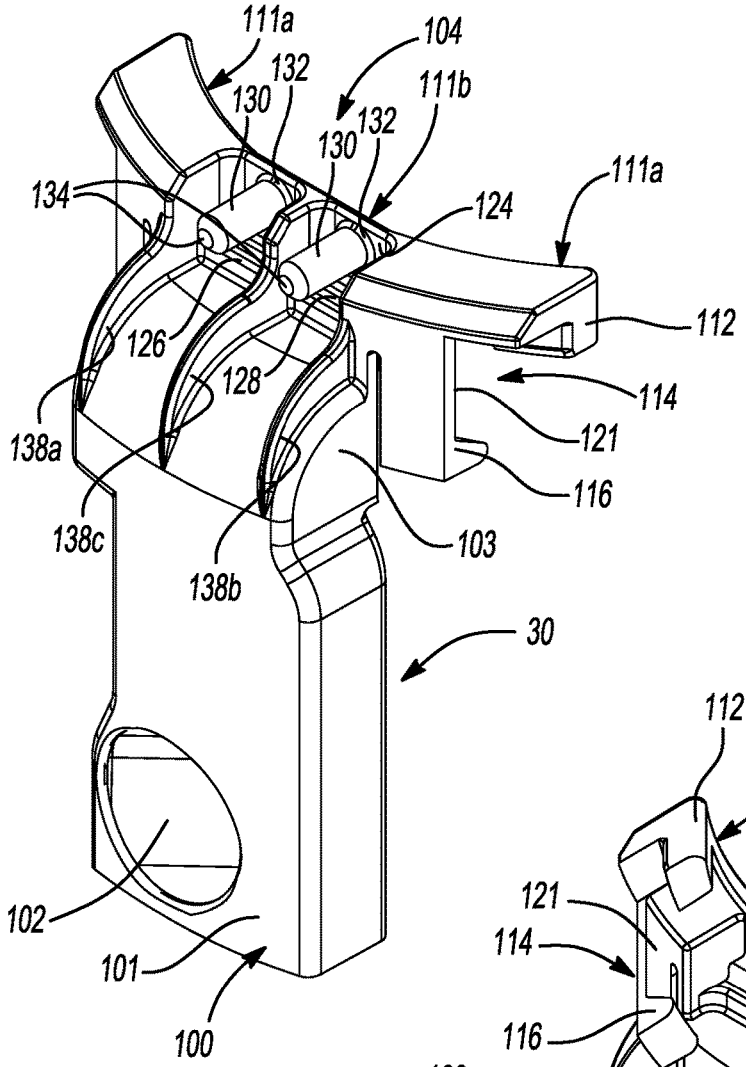
FIG. 7 is a perspective view of the suction conduit.
Figure 10:
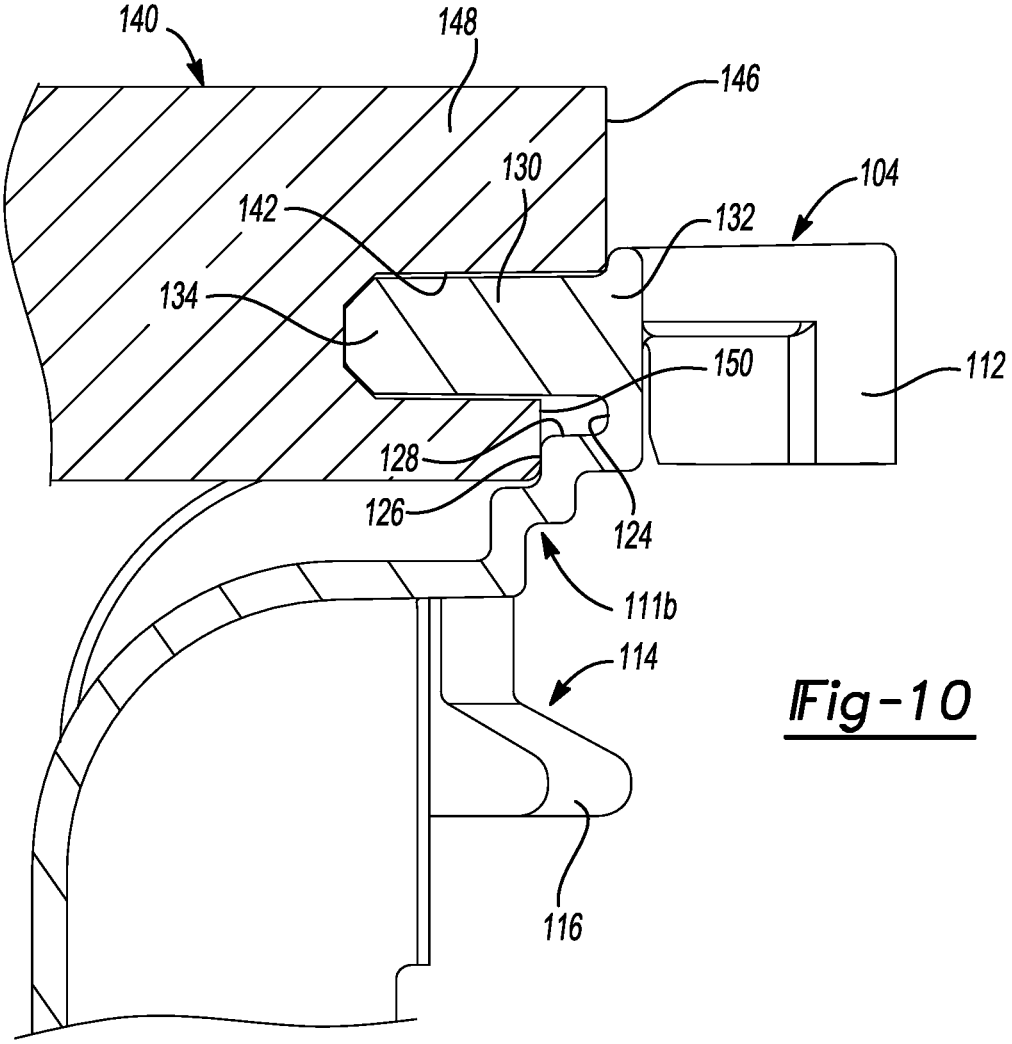
FIG. 10 is a partial cross-sectional view of the assembly tool coupled to the suction conduit.

As shown in FIGS. 3, 4 and 7, the middle portion 111*b* of the connecting arm 104 may include a first wall 124 and a second wall 126 that are offset from each other (the first wall 124 the second wall 126 are not aligned with each other). The first wall 124 and the second wall 126 may cooperate with each other to define a horizontal step 128 in the middle portion 111*b* (FIG. 10). The middle portion 111*b* may also include one or more cylindrically-shaped attachment or locating pins 130 that extend outwardly in a radial direction from the first wall 124. In some configurations, the pins 130 may extend outwardly in a radial direction from the second wall 126. In other configurations, one or more of the pins 130 may extend outwardly in a radially direction from the first wall 124 and one or more of the pins 130 may extend outwardly in a radial direction from the second wall 126. As shown in FIGS. 7 and 10, each pin 130 includes a proximate end 132 and a distal end 134. The proximate end 132 extends from the first wall 124. The distal end 134 has a chamfered edge.

In one embodiment, one or more ribs 138*a*, 138*b*, 138*c* may extend from the middle portion 111*b* of the connecting arm 104 and the body 100 and provide additional strength to the suction conduit 30. The ribs 138*a*, 138*b*, 138*c* are spaced apart from each other. That is, two of the ribs 138*a*, 138*b* extend from opposing ends of the middle portion 111*b* of the connecting arm 104 and from opposing ends of the body 100. One of the ribs 138*c* extends from a central area of the middle portion 111*b* and a central area of the body 100, and is also positioned between two of the pins 130. In some configurations, the suction conduit 30 may not include any ribs.

With continued reference to FIGS. 1-10, assembly of the suction conduit 30 to the non-orbiting scroll 72 will now be described in detail. An attachment tool 140 is first secured to the suction conduit 30 (FIG. 10). That is, an operator (human or automated robot) couples the attachment tool 140 to the suction conduit 30 so that the pins 130 of the suction conduit 30 are received in similarly-shaped apertures 142 in the attachment tool 140 and the ribs 138*a*, 138*b*, 138*c* of the suction conduit 30 are received in recesses 144 of the attachment tool 140. When the pins 130 of the suction conduit 30 are fully received in similarly-shaped apertures 142 of the attachment tool 140 and the ribs 138*a*, 138*b*, 138*c* are fully received in recesses 144 of the attachment tool 140, a first outer surface 146 at an end 148 of the tool 140 abuts against the first wall 124 of the middle portion 111*b* and a second outer surface 150 at the end 148 abuts against the second wall 126 of the middle portion 111*b*. In this way, the attachment tool 140 is securely coupled the suction conduit 30 (i.e., the suction conduit 30 is restricted from moving relative to the attachment tool 140). In some configurations, when the suction conduit 30 does not include horizontal step 128, the second outer surface 150 of the assembly tool 140 abuts against the first wall 124 of the middle portion 111*b*.

The operator then assembles the suction conduit 30 to the non-orbiting scroll 72 using the attachment tool 140. That is, while holding the attachment tool 140, the operator positions the suction conduit 30 onto the non-orbiting scroll 72 until the connecting arm 104 snaps into engagement with the non-orbiting scroll 72. Once the suction conduit 30 snaps into engagement with the non-orbiting scroll 72, the operator conveniently decouples the attachment tool 140 from the suction conduit 30.

The suction conduit 30 of the present disclosure provides the benefit of allowing the attachment tool 140 to be coupled thereto, which facilitates coupling the suction conduit 30 to the non-orbiting scroll 72. In this way, an operator working in an assembly line, for example, is allowed to assemble suction conduits 30 to non-orbiting scrolls 72 without experiencing fatigue stemming from assembling the suction conduits 30 to the non-orbiting scrolls 72 by hand (i.e., without the attachment tool 140). Although the attachment tool 140 in the present disclosure is used to facilitate attachment of the suction conduit 30 to the non-orbiting scroll 72 whereby the suction conduit 30 is snapped into engagement with the non-orbiting scroll 72, the attachment tool 140 may also be used to facilitate attaching the suction conduit 30 to the non-orbiting scroll 72 whereby the suction conduit 30 is attached to the non-orbiting scroll 72 by fasteners (e.g., screws, bolts, etc.). The attachment tool 140 may also be used to remove the suction conduit 30 from the non-orbiting scroll 72.

Figure 11:
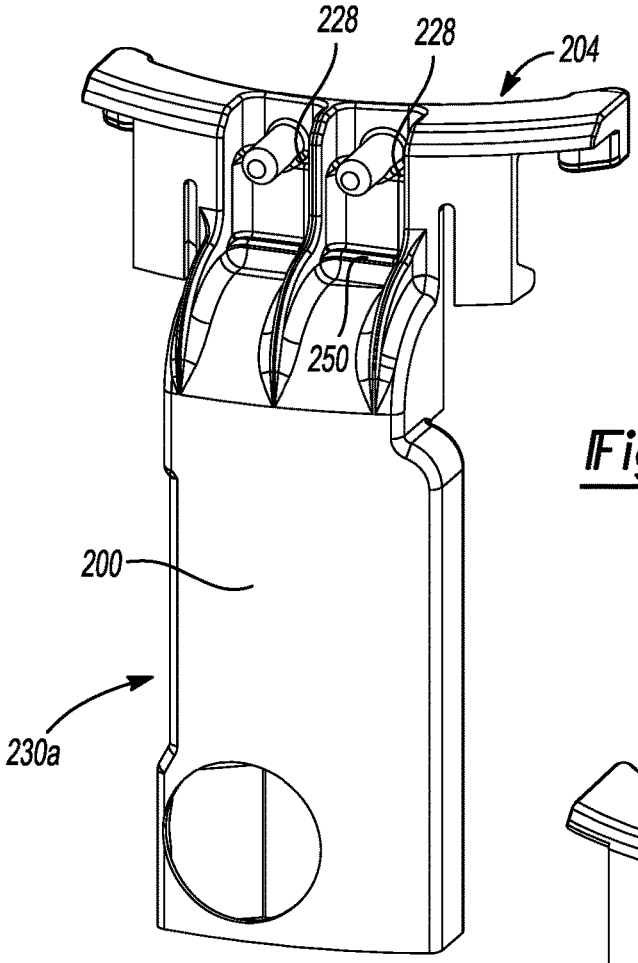
FIG. 11 is a perspective view of an alternate suction conduit.
Figure 12:
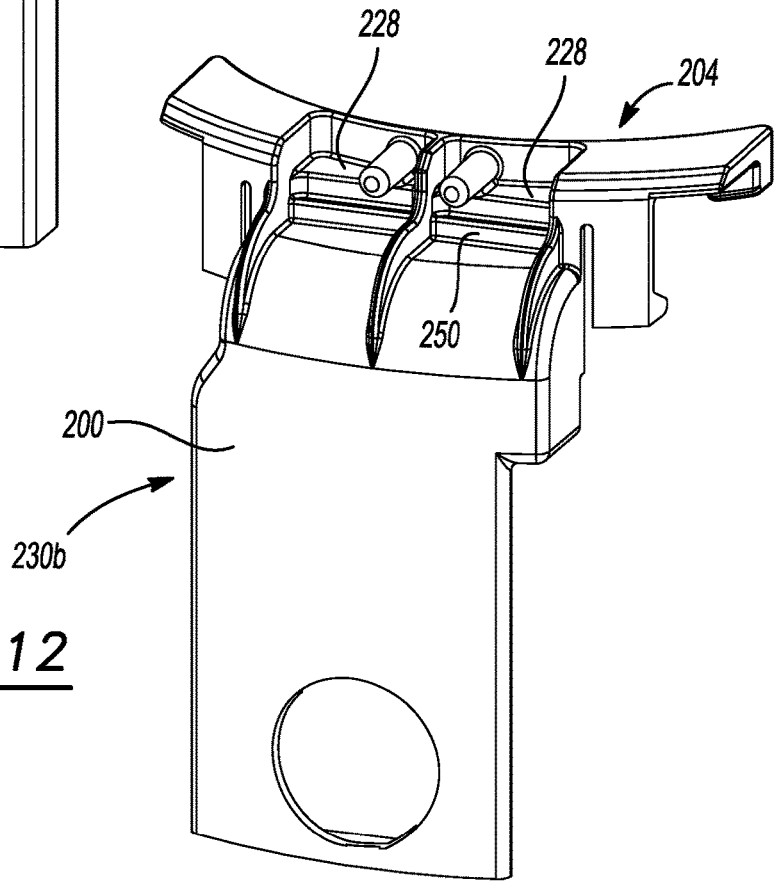
FIG. 12 is a perspective view of another alternate suction conduit.

With reference to FIGS. 11 and 12, suction conduits 230*a*, 230*b* are provided. Each of the suction conduits 230*a*, 230*b* may be incorporated into the compressor 10 instead of the suction conduit 30. The structure and function of the suction conduits 230*a*, 230*b* may be similar or identical to that of the suction conduit 30 described above, apart from any difference noted below.

Each suction conduit 230*a*, 230*b* may include a body 200 and a connecting arm 204. The body 200 may be similar or identical to the body 100 described above and therefore will not be described again in detail. As shown in FIGS. 11 and 12, each connecting arm 204 has a horizontal step 228 that is positioned at a different vertical height relative to an end 250 of the body 200. In this way, each conduit 230*a*, 230*b* can be properly coupled to and sealed with a different size non-orbiting scroll.

Figure 13:
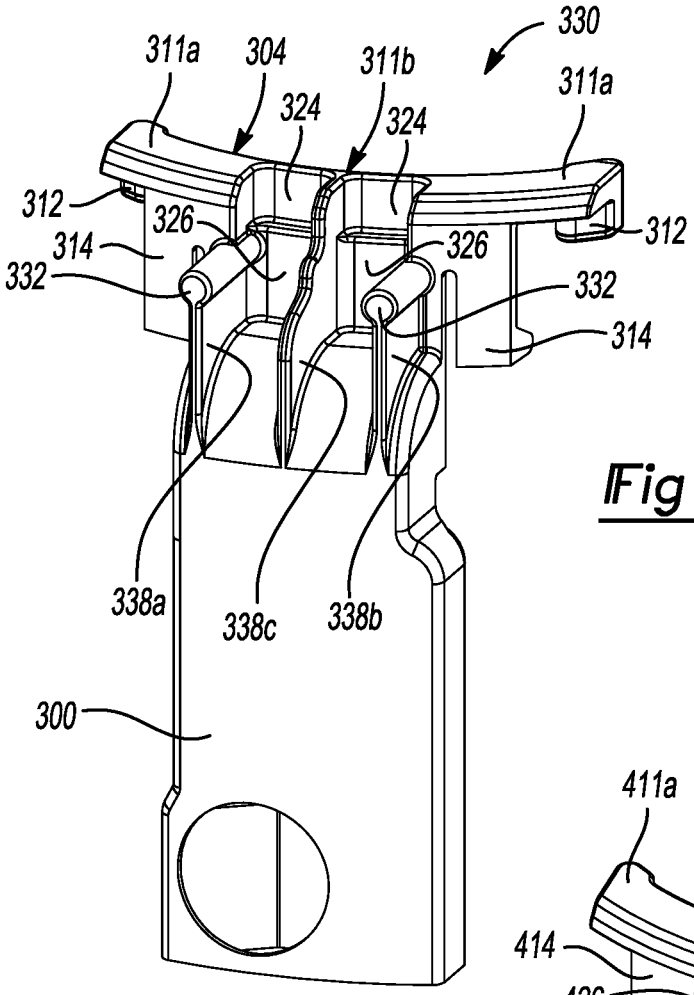
FIG. 13 is a perspective view of yet another alternate suction conduit.
Figure 14:
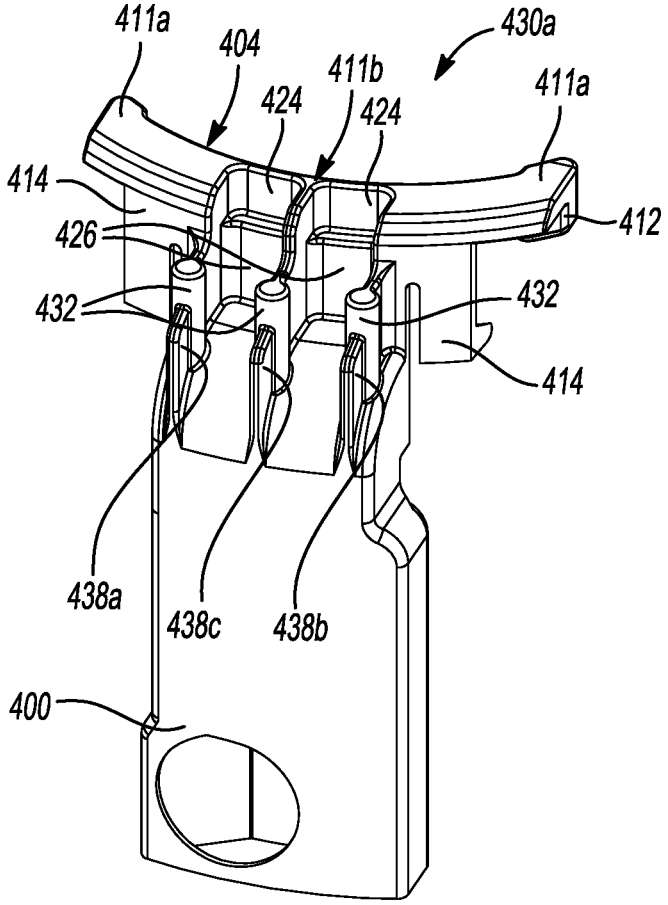
FIG. 14 is a perspective view of yet another alternate suction conduit.

With reference to FIG. 13, another suction conduit 330 is provided. The suction conduit 330 may be incorporated into the compressor 10 instead of suction conduits 30, 230*a*, 230*b* described above. The structure and function of the suction conduit 330 may be similar or identical to that of the suction conduits 30, 230*a*, 230*b* described above, apart from any difference noted below.

The suction conduit 330 may include a body 300, a bridge (not shown) and a connecting arm 304. The body 300 may be similar or identical to the bodies 100, 200 described above, and therefore, will not be described again in detail. The bridge may be similar or identical to the bridge 110 described above, and therefore, will not be described again in detail.

The connecting arm 304 may include end portions 311*a* and a middle portion 311*b*. The end portions 311*a* may include bosses 312 and a plurality of resiliently flexible tabs 314. The bosses 312 and the flexible tabs 314 may be similar or identical to the bosses 112 and the flexible tabs 114, respectively, described above, and therefore, will not be described again in detail. The middle portion 311*b* may include a first wall 324 and a second wall 326 that are offset from each other (the first wall 324 the second wall 326 are not aligned with each other). The first wall 324 and the second wall 326 may cooperate with each other to define a horizontal step in the middle portion 311*b*.

One or more ribs 338*a*, 338*b*, 338*c* may extend from the middle portion 311*b* of the connecting arm 304 and the body 300 and provide additional strength to the suction conduit 330. The plurality of ribs 338*a*, 338*b*, 338*c* are spaced apart from each other. That is, the ribs 338*a*, 338*b* extend from opposing ends of the middle portion 311*b* of the connecting arm 304 and from opposing ends of the body 300. The rib 338*c* extends from a central area of the middle portion 311*b* and a central area of the body 300.

One or more cylindrically-shaped attachment pins 332 may be integral with the outer ribs 338*a*, 338*b* and may extend in a radial direction. In some configurations, the pins 332 may be triangular-shaped, star-shaped, rectangular-shaped, L-shaped or any other suitable shape that allows an assembly tool (not shown) to be coupled thereto for facilitating attachment of the suction conduit 330 to the non-orbiting scroll 72. In some configurations, one or more pins 332 may extend in the radial direction and one or more pins 332 may extend in the axial direction.

With reference to FIGS. 14-17, suction conduits 430*a*, 430*b*, 430*c*, 430*d* are provided. Each suction conduit 430*a*, 430*b*, 430*c*, 430*d* may be incorporated into the compressor 10 instead of suction conduits 30, 230*a*, 230*b*, 330 described above. The structure and function of the suction conduits 430*a*, 430*b*, 430*c*, 430*d* may be similar or identical to that of the suction conduits 30, 230*a*, 230*b*, 330 described above, apart from any difference noted below.

Each suction conduit 430*a*, 430*b*, 430*c*, 430*d* may include a body 400, a bridge (not shown) and a connecting arm 404. The body 400 may be similar or identical to the bodies 100, 200, 300 described above, and therefore, will not be described again in detail. The bridge may be similar or identical to the bridge 110 described above, and therefore, will not be described again in detail.

The connecting arm 404 may include end portions 411*a* and a middle portion 411*b*. The end portions 411*a* may include bosses 412 and a plurality of resiliently flexible tabs 414. The bosses 412 and the flexible tabs 414 may be similar or identical to the bosses 112 and the flexible tabs 114, respectively, described above, and therefore, will not be described again in detail. The middle portion 411*b* may include a first wall 424 and a second wall 426 that are offset from each other (the first wall 424 the second wall 426 are not aligned with each other). The first wall 424 and the second wall 426 may cooperate with each other to define a horizontal step in the middle portion 411*b*.

One or more ribs 438*a*, 438*b*, 438*c* may extend from the middle portion 411*b* of the connecting arm 404 and the body 400 and provide additional strength to the suction conduit 430*a*, 430*b*, 430*c*. The plurality of ribs 438*a*, 438*b*, 438*c* are spaced apart from each other. That is, the ribs 438*a*, 438*b* extend from opposing ends of the middle portion 411*b* of the connecting arm 404 and from opposing ends of the body 400. The rib 438*c* extends from a central area of the middle portion 411*b* and a central area of the body 400.

Figure 15:
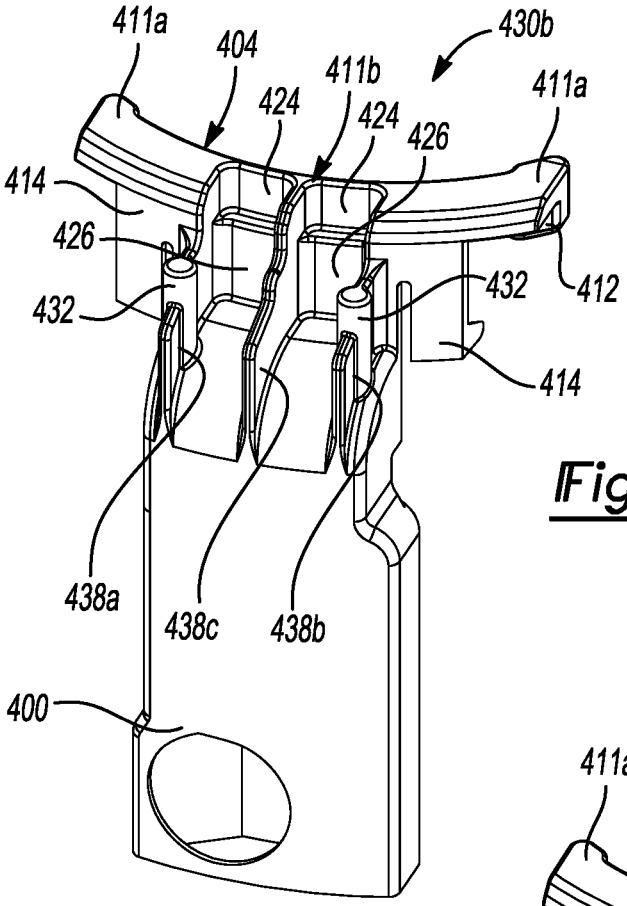
FIG. 15 is a perspective view of yet another alternate suction conduit.
Figure 16:
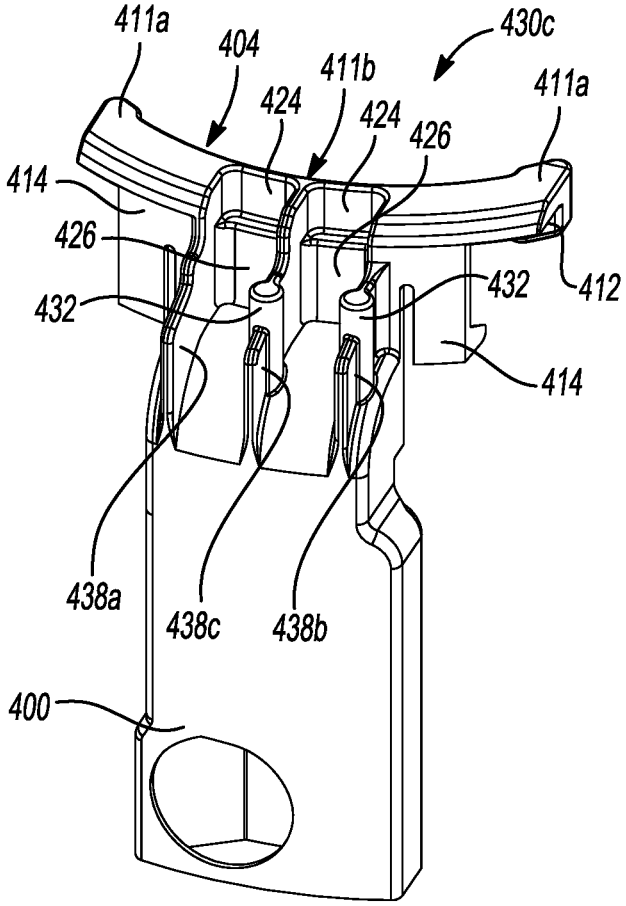
FIG. 16 is a perspective view of yet another alternate suction conduit.
Figure 17:
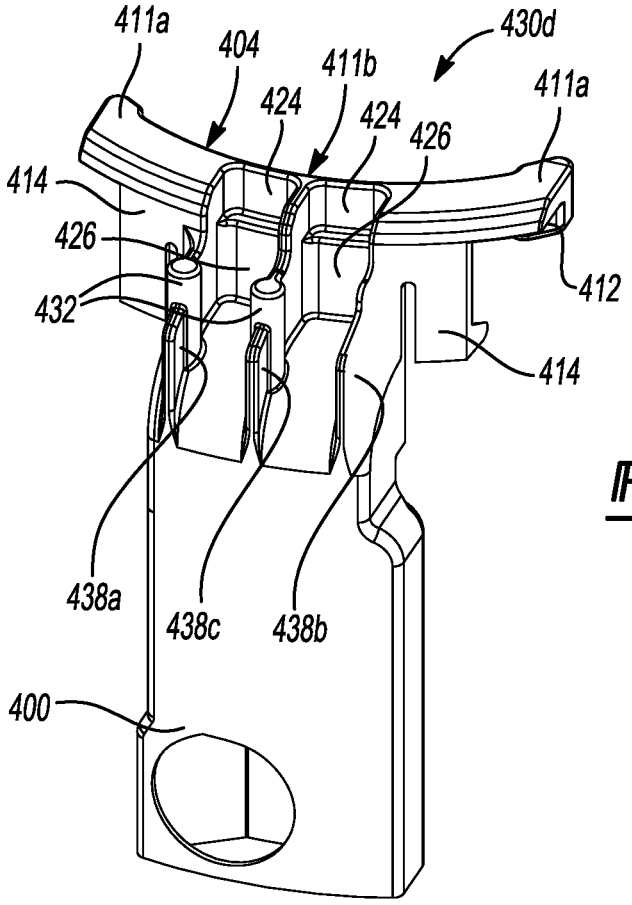
FIG. 17 is a perspective view of yet another alternate suction conduit.

One or more cylindrically-shaped attachment pins 432 may be integral with the ribs 438*a*, 438*b*, 438*c* and may extend in an axial direction. In some configurations, as shown in FIG. 15, the pins 432 may be integral with each rib 438*a*, 438*b*, 438*c*. In other configurations, as shown in FIGS. 15-17, pins 432 may be integral with only two of the ribs 438*a*, 438*b*, 438*c* instead of being integral with all three ribs 438*a*, 438*b*, 438*c*. In this way, the assembly tool (not shown) used to attach the suction conduit to the non-orbiting scroll may be unique to a specific suction conduit. That is, each suction conduit may have pins of a specific number, shape, and position which corresponds to a matching assembly tool. Thus, when assembling the suction conduit to the non-orbiting scroll, this ensures that each conduit is assembled to the proper non-orbiting scroll and allows for post-assembly detection of the suction conduits. This also provides the benefit of fool-proofing the assembly process (avoiding attaching a suction conduit to the incorrect non-orbiting scroll, for example).

Figure 18:
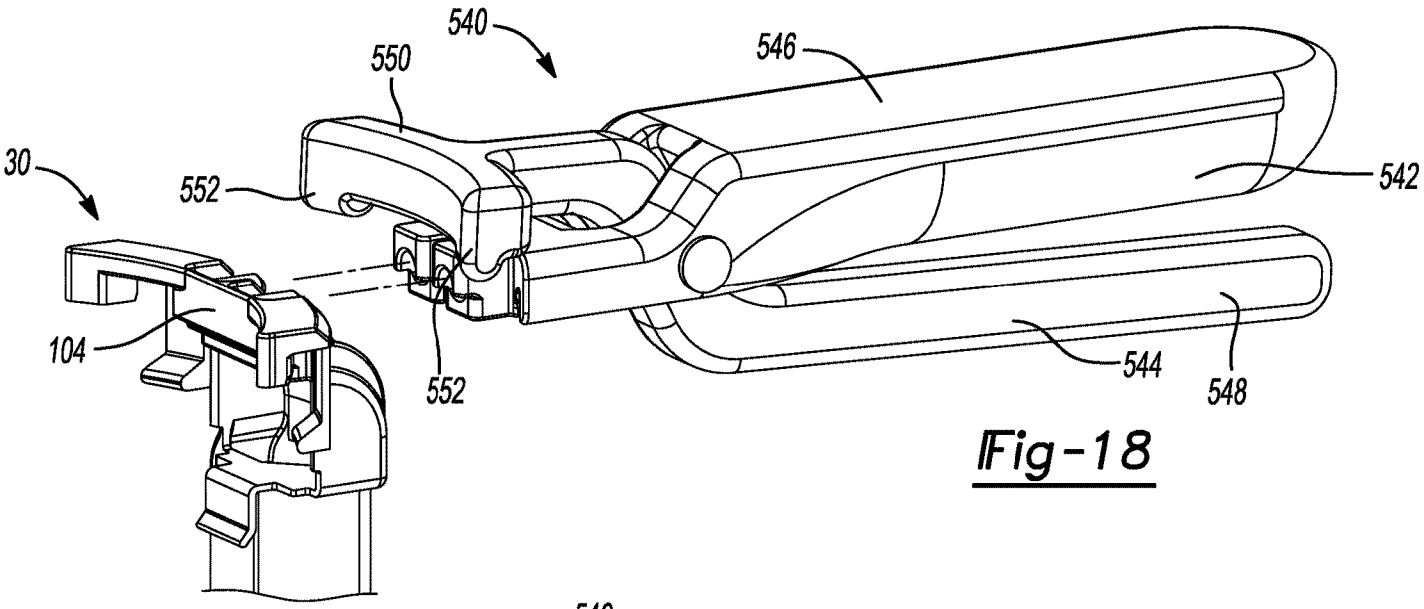
FIG. 18 is a perspective view of an assembly tool and suction conduit.
Figure 19:
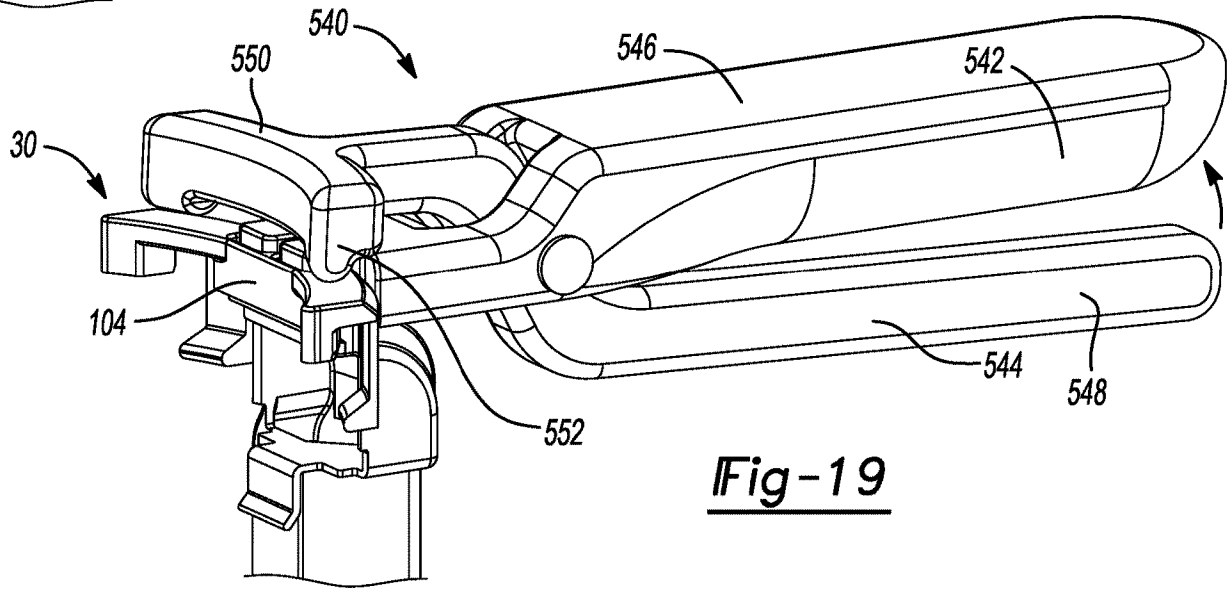
FIG. 19 is a perspective view of the assembly tool attached to the suction conduit.

With reference to FIGS. 18 and 19, an assembly tool 540 is provided. The assembly tool 540 may be used to attach the suction conduit 30 to the non-orbiting scroll 72 instead of assembly tool 140. The structure and function of the assembly tool 540 may be similar or identical to that of the assembly tool 140 described above, apart from any difference noted below.

The attachment tool 540 includes a handle 542 and a lever 544 pivotably attached to the handle 542. The handle 542 includes a gripping portion 546 that allows an operator (human or automated robot) to conveniently grip when attaching the conduit 30 to the non-orbiting scroll 72. The lever 544 includes a gripping portion 548 and a stabilizing arm 550. The stabilizing arm 550 may include opposing end portions 552 that are configured to contact the connecting arm 104 of the conduit 30 when the conduit 30 is securely attached to the handle 542. In this way, the arm 550 helps to retain attachment of the conduit 30 (hold the conduit 30 firmly in place on the handle 542) as it is being connected to the non-orbiting scroll 72. When the conduit 30 is coupled to the non-orbiting scroll 72, the operator may rotate the gripping portion 548 of the lever 544 such that the end portions 552 are disengaged from the connecting arm 104. In this way, the handle 542 may be conveniently decoupled from the conduit 30.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly defining a chamber;

a compression mechanism disposed within the chamber of the shell assembly and including a first scroll member and a second scroll member in meshing engagement with each other, the second scroll member including a suction inlet; and a suction conduit directing working fluid into the suction inlet and including a first end defining an inlet opening and a second end defining an outlet opening adjacent to the suction inlet, the second end including a locating pin extending outwardly therefrom, wherein the location pin is spaced apart from the second scroll member and spaced apart from the shell assembly.

2. The compressor of claim 1, wherein an end of the locating pin is chamfered.

3. The compressor of claim 1, wherein the locating pin is cylindrically-shaped.

4. The compressor of claim 1, wherein the second end includes an arcuate connecting arm, and wherein the locating pin extends from the connecting arm.

5. The compressor of claim 4, wherein the connecting arm is configured to snap into engagement with the second scroll member, and wherein the connecting arm includes a first boss extending therefrom and received within an externally located slot of the second scroll member when the connecting arm snaps into engagement with the second scroll member.

6. The compressor of claim 4, wherein the connecting arm is configured to snap into engagement with the second scroll member, and wherein the second scroll member includes externally located grooves formed therein and the connecting arm includes resiliently flexible tabs extending therefrom, the resiliently flexible tabs are received within respective grooves to prevent axial movement of the suction conduit relative to the second scroll member when the connecting arm snaps into engagement with the second scroll member.

7. The compressor of claim 1, wherein the second end of the suction conduit includes another locating pin extending outwardly therefrom.

8. The compressor of claim 1, wherein the locating pin extends from the suction conduit away from the second scroll member.

9. A compressor comprising:

a shell assembly defining a chamber;

a compression mechanism disposed within the chamber of the shell assembly and including a first scroll member and a second scroll member in meshing engagement with each other, the second scroll member includes a suction inlet; and a suction conduit directing working fluid into the suction inlet and including a body and an arcuate connecting arm, the body having a first end defining an inlet opening and a second end defining an outlet opening, the arcuate connecting arm configured to snap into engagement with the second scroll member and having a locating pin extending outwardly therefrom, wherein the locating pin does not extend into the second scroll member and does not extend into the shell assembly.

10. The compressor of claim 9, wherein the arcuate connecting arm includes end portions and a middle portion disposed between the end portions, and wherein the locating pin extends from a wall of the middle portion.

11. The compressor of claim 10, wherein the arcuate connecting arm includes another locating pin, and wherein at least one reinforcement rib extends from the middle portion and the body, and wherein the at least one reinforcement rib is positioned between the locating pins.

12. The compressor of claim 9, wherein the arcuate connecting arm includes another locating pin, and wherein the arcuate connecting arm includes end portions and a middle portion disposed between the end portions, and wherein reinforcement ribs extend from the middle portion and the body, the locating pins are integral with at least two of the reinforcement ribs.

13. The compressor of claim 12, wherein the locating pins extend in one of a radial direction and an axial direction.

14. The compressor of claim 9, wherein the locating pin extends from the arcuate connecting arm away from the second scroll member.

* * * * *